US005410211A

United States Patent [19]

Kyushima

[11] Patent Number: 5,410,211

[45] Date of Patent: Apr. 25, 1995

[54] ELECTRON TUBE WITH AN ELECTRON MULTIPLIER HAVING A PLURALITY OF STAGES OF DYNODES

[75] Inventor: Hiroyuki Kyushima, Hamamatsu, Japan

[73] Assignee: Hamamatsu Photonics, K.K., Hamamatsu, Japan

[21] Appl. No.: 996,693

[22] Filed: Dec. 24, 1992

[30] Foreign Application Priority Data

Dec. 26, 1991 [JP] Japan ..... 3-344895

[51] Int. Cl.[6] ..... H01J 43/00

[52] U.S. Cl. ..... 313/103 R; 313/103 CM; 313/105 R; 313/105 CM; 313/533

[58] Field of Search ..... 313/103 R, 103 CM, 104, 313/116, 377, 379, 387, 528, 532, 533, 534, 105 R, 105 CM

[56] References Cited

U.S. PATENT DOCUMENTS

| | | | |
|---|---|---|---|
| 3,939,374 | 2/1976 | Schagen et al. . | |
| 4,482,836 | 11/1984 | Washington et al. | 313/104 |
| 4,649,314 | 3/1987 | Eschard | 313/103 CM |
| 4,806,827 | 2/1989 | Eschard | 313/533 |
| 4,825,118 | 4/1989 | Kyushima . | |
| 5,254,906 | 10/1993 | Kimura | 313/104 |

*Primary Examiner*—Sandra L. O'Shea
*Assistant Examiner*—Vip Patel
*Attorney, Agent, or Firm*—Cushman Darby & Cushman

[57] ABSTRACT

The electron tube according to this invention comprises an electron multiplier for multiplying incident electron flows by secondary electron emission. This electron multiplier includes a plurality of stages of dynodes laid one on another, and each stage dynode includes a number of through-holes each having an electron input opening on one end and an electron output opening on the other end. The electron output opening has a larger area than the electron input opening.

18 Claims, 10 Drawing Sheets

ELECTRON TUBE WITH AN ELECTRON MULTIPLIER HAVING A PLURALITY OF STAGES OF DYNODES

BACKGROUND OF THE INVENTION

1. Field of Industrial Application

This invention relates to an electron tube with an electron multiplier for multiplying the flow of incident electrons by secondary electron emission.

2. Related Background Art

Electron tubes for multiplying the flow of incident electrons by secondary electron emission conventionally known are electron multipliers, photomultipliers and image intensifiers, etc. The electron multipliers disposed in these electron tubes usually comprise a plurality of stages of dynodes with secondary electron emission.

A sectional view of the dynodes constituting one of these electron multipliers is shown in FIG. 1. In FIG. 1 the n-th stage and the (n+1)-th stage laid on the n-th stage are extracted out of a plurality of stages of dynodes which are laid one on another and which are electrically insulated from one another.

The dynode 80 of each stage includes a plate 82 having a plurality of through-holes 81 formed therein. The plate 82 of each stage is turned with respect to that of a next stage so that the through-holes 81 of the former stage are directed opposite to those of the latter. The plates 82 of the respective stages are supplied with predetermined voltages by power sources 83 associated with the respective stages so that the dynodes 80 of the respective stages have gradually increased potentials. In the case of FIG. 1, $V_1=100$ V, and $V_2=200$ V. The surface of each plate 82 including the inner surfaces of the through-holes 81 are electrically conducting, and the entire surface of each plate 82 is charged with the same potential by a voltage applied thereto.

When electrons are incident on the n-th one of the thusarranged stages of dynodes, electrons incident on the through-holes 81 impinge on the slant surfaces 84 of the through-holes 81, and secondary electrons are emitted from secondary electron emitting layers formed on the slant surfaces 84. The emitted secondary electrons are guided by a control electric field formed by a potential difference between the n-th and the (n+1)-th stages to be incident on the (n+1)-th dynode and multiplied there again in the same way.

Distributions of the potential between the n-th and the (n+1)-th stages are shown by the dot-lines in FIG. 1. For example, equipotential lines of 120 V, 150 V and 18O V are shown and indicated respectively by A, B and C. The equipotential line B is located intermediate between the n-th and the (n+1)-th stages, and the equipotential line A and the equipotential line C are curved respectively in the through-holes of the n-th stage and in those of the (n+1)-th stage.

As described above, the secondary electrons emitted from the n-th dynode 80 are guided by a control electric field formed by a potential difference between the n-th and the (n+1)-th stages to be incident on the (n+1)-th stage dynode 80. But in such conventional dynodes, the curve-in of the equipotential line into the through-holes 81 of the n-th stage, which functions as a control electric field, is insufficient. It is a disadvantage that the control electric fields in the through-holes are weak. As a result, emitted secondary electrons often adversely return to the n-th stage, which is one cause for lowering the electron collecting efficiency.

SUMMARY OF THE INVENTION

An object of this invention is to provide an electron tube with an electron multiplier in which control electric fields are curved sufficiently into the through-holes of the dynodes, whereby the electron collecting efficiency can be much improved.

According to one aspect of this invention, in the electron tube with an electron multiplier for multiplying incident electron flows by secondary electron emission according to this invention, the electron multiplier comprises a plurality of stages of dynodes laid one on another; each of the dynodes include a number of through-holes, each of which has an electron input opening at one end and an electron output opening at the other end; each of the through-holes has a secondary electron emitting surface formed on an inner surface thereof; and the electron output opening of each through-hole has a larger area than the electron input opening.

Because of the through-holes of such configuration, the inner surface of each through-hole is tapered increasingly toward the electron output opening. As a result, a control electric field for guiding emitted secondary electrons to a next stage dynode enters through the larger-area electron output openings, ascends toward the inner surface of an opposite side to intrude deep in the through-holes.

The secondary electron emitting surfaces may be formed by inwardly projected parts of the inner surfaces of the through-holes.

The dynode of each stage is laid on its adjacent stage dynode so that a direction of slant of the secondary electron emitting surfaces of the former dynode formed by the inwardly projected parts of the inner surfaces of the through-holes of the former dynode is opposite to a direction of slant of those of the latter dynode.

It is preferable that shapes of the electron input openings and of the electron output openings of the through-holes are circular, rectangular or hexagonal.

The electron tube with an electron multiplier according to this invention may comprise convergence electrodes for converging orbits of electrons entering the first stage dynode, or a photocathode for emitting photoelectrons by incident light beams.

The electron tube with an electron multiplier according to this invention is applicable to an image intensifier for increasing luminance of an input light image.

DESCRIPTION OF PREFERRED EMBODIMENTS

Preferred embodiments of this invention will be explained below with reference to the drawings attached hereto.

Figure 2:
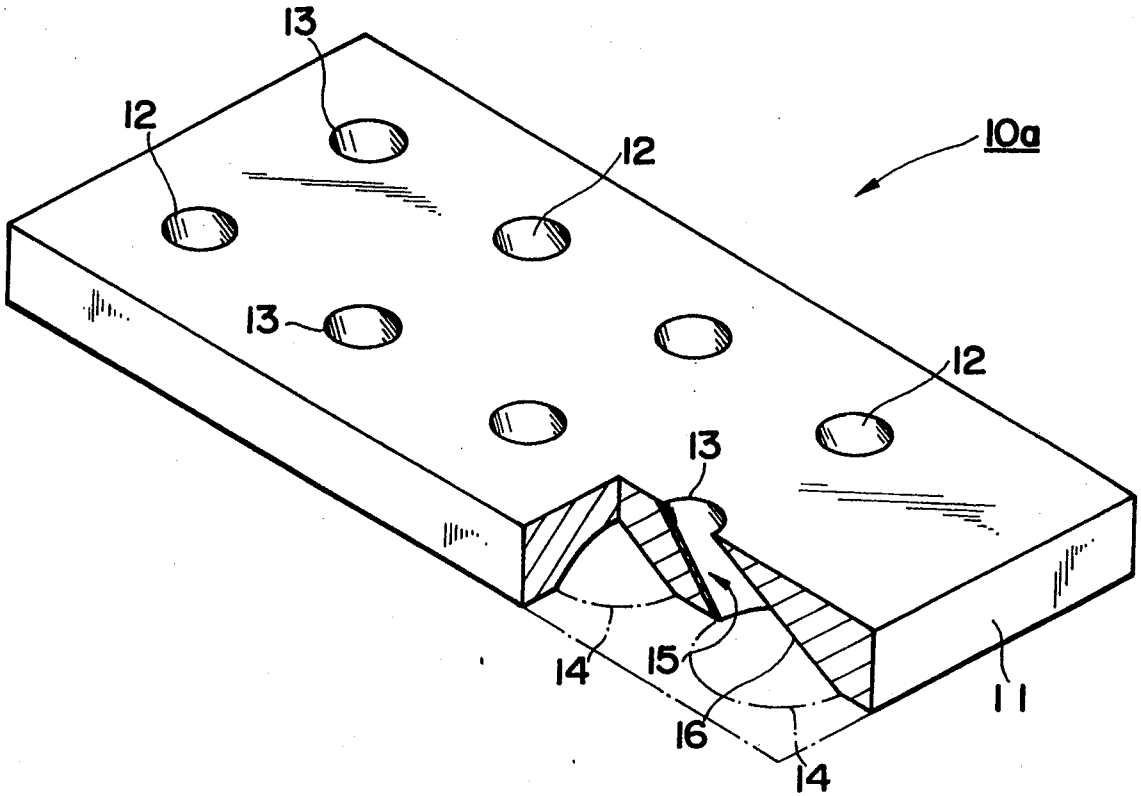
FIG. 2 is a partially broken perspective view of a dynode constituting the electron multiplier according to this invention.

FIG. 2 shows a first embodiment of the dynode constituting the electron multiplier provided in an electron tube.

The dynode 10*a* according to the first embodiment includes a plate 11 having an electrically conducting surface. In the plate 11 there are formed a plurality of cylindrical through-holes 12 by etching or other means in a regular arrangement. On the top surface of the plate 11 there are formed circular input openings 13 (for electrons) which form one end of the through-holes 12, and circular output openings 14 (for electrons) which form the other end of the through-holes 12 on the backside of the plate 11. The plate 11 must have an electrically conducting surface including the inner surfaces of the through-holes, but may be hollow.

The output opening 14 of each of the through-holes 12 has a larger diameter than the associated input opening 13, so that the inner surface of the through-hole 12 is tapered increasingly toward the output opening 14. The through-hole 12 is formed so as to be slant to an incidence direction of electrons entering through the input opening 13. On a part of the slant inner surface of the through-hole 12 there is formed a secondary electron emitting surface 15 on which the electrons entering through the input opening 13 impinge. The secondary electron emitting surface 15 is formed by vaporizing antimony (Sb) and reacting the antimony with alkali. Alternatively, the secondary electron emitting surface 15 can be formed by forming the electrically conducting plate 11 of CuBe, and activating the CuBe in oxygen. The secondary electron emitting surface 15 may be formed on the entire inner surface of the through-hole 12.

The function of the electron multiplier using the dynodes 1O*a* having the above-described structure will be explained with reference to FIG. 3.

Figure 3:
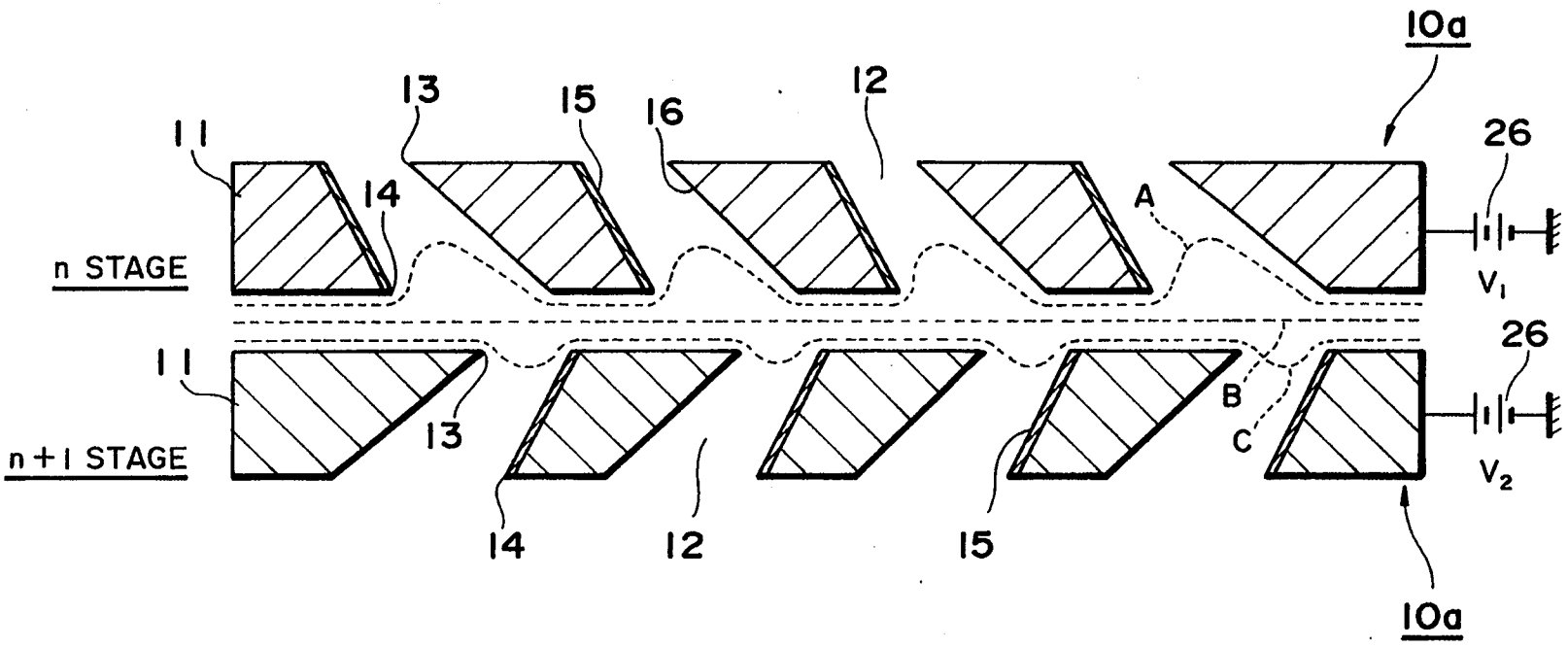
FIG. 3 is a view of two continuous stage dynodes extracted out of a plurality of stages of dynodes constituting the electron multiplier.

FIG. 3 shows the n-th stage and the (n+1)-th stage laid on the n-th stage extracted out of a plurality of stages of dynodes constituting the electron multiplier. The respective stage dynode is laid on its adjacent stage dynode so that an inclination of the through-holes of the former plate 11 are opposite to that of the through-holes of the latter plate 11. The respective dynodes 1O*a* are supplied with predetermined voltages by power sources 26.

Figure 1:
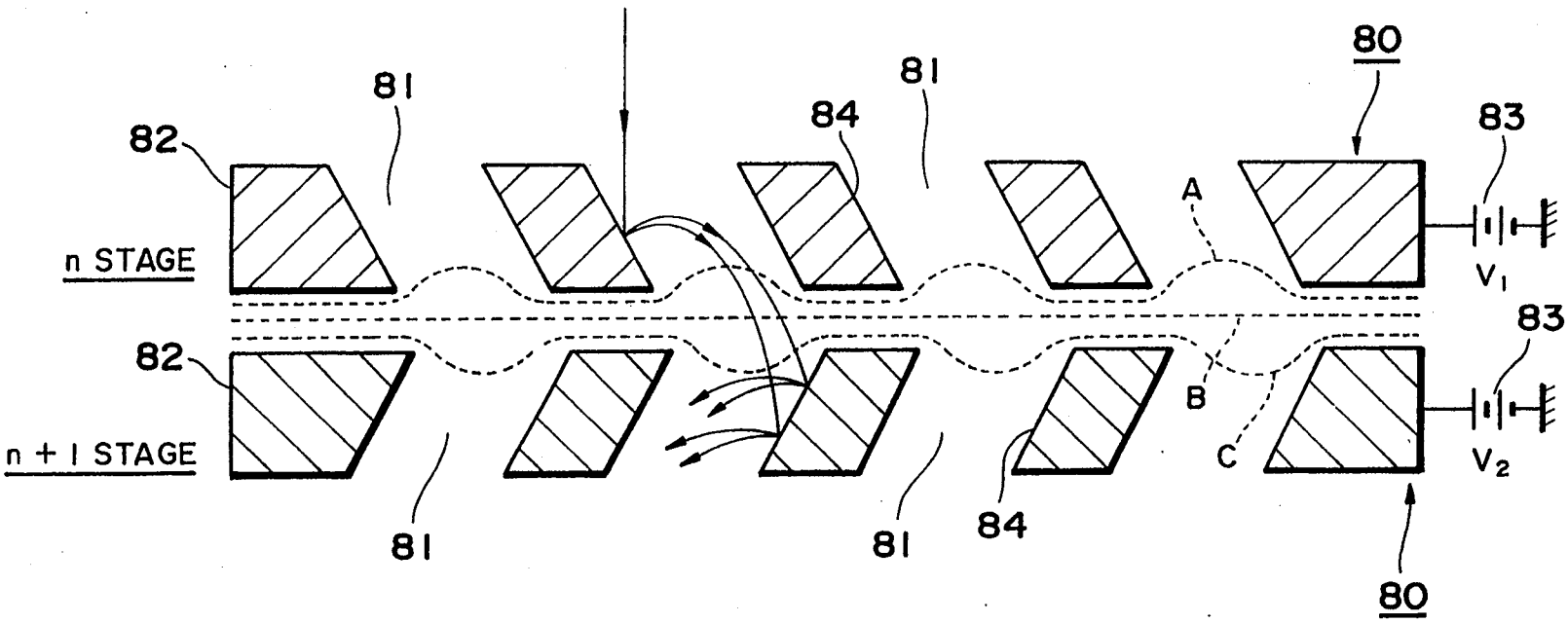
Fig. 1 (PRIOR ART)
FIG. 1 is a sectional view of two continuous stages of dynodes constituting a conventional electron multiplier.

Distributions of potentials of the respective dynodes 1O*a* in the case that $V_1=100$ V and $V_2=200$ V are applied respectively to the n-th and the (n+1)-th stage dynodes are indicated by the dot lines. As in the conventional example (FIG. 1), equipotential lines of 120 V, 150 V and 180 V are shown, for example, and are represented respectively by A, B and C.

In this case as well, the equipotential line B is intermediate between the former and the latter stages, and the equipotential line A and the equipotential line C curve in the through-holes 12 respectively through the output openings 14 and the input openings 13. In comparison with the case of FIG. 1, the equipotential line A, which curves in the output openings 14, ascends along the slant surfaces 16 opposed to the secondary electron emitting surfaces 15 deep into the through-holes.

Thus, in comparison with the case in which the output openings 14 have the same diameter as the input openings 13 and the through-holes have a cylindrical configuration having a constant bore, the present embodiment provides a tapered bore of the through-holes 12 increasing toward the output openings 14 which allows the equipotential line (i.e., a control electric field which guides the secondary electrons) to intrude deep into the through-holes 12.

Figure 4:
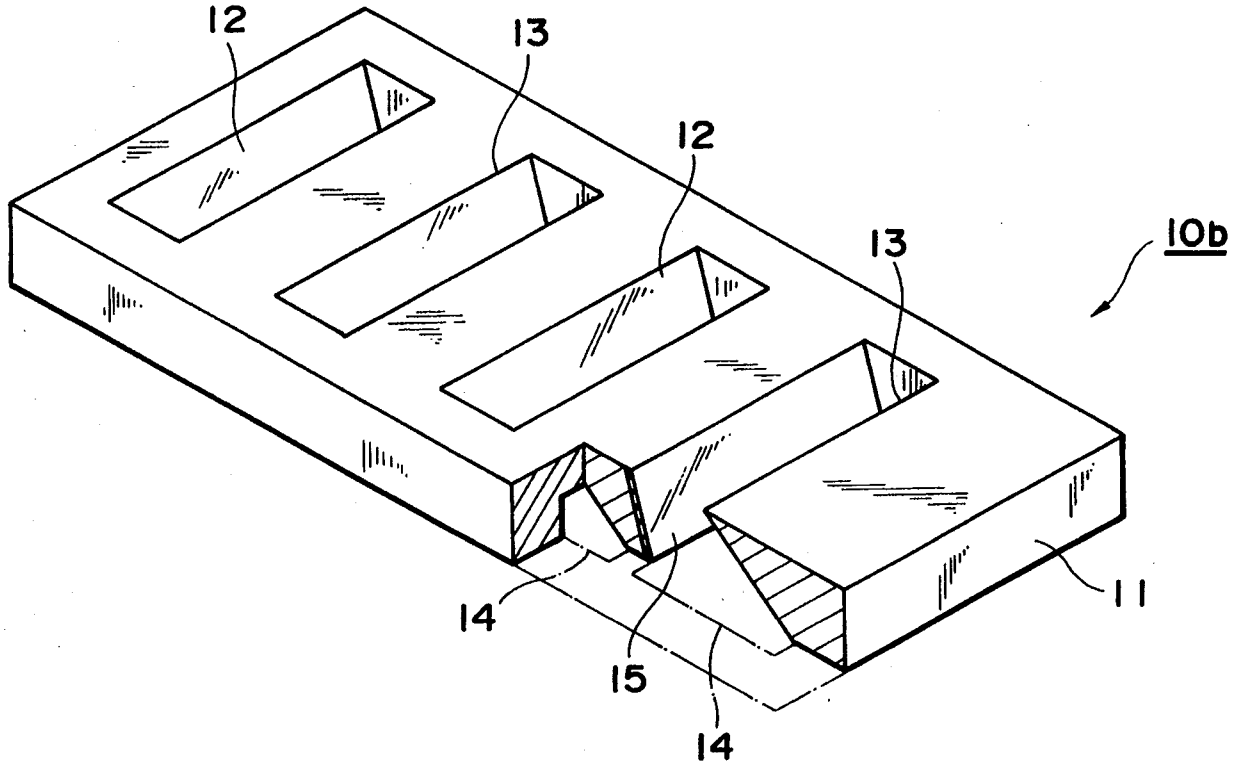
FIG. 4 is a partially broken perspective view of a dynode having through-holes of another different configuration.

A second embodiment of the dynodes constituting the electron multiplier will be explained below with reference to FIG. 4.

Each of the dynodes 10b according to the second embodiment includes through-holes 12, the input openings 13 and the output openings 14 of which are rectangular, and which are arranged in one row. Each of the through-holes 12 has a rectangular sectional area which increases toward the output opening 14, and the output opening 14 has a larger sectional area than the input opening 13. The electrons entering through the input openings 13 impinge on the secondary electron emitting surfaces and achieve the same function and effect as in the first embodiment. The dynodes 10*b* having such configuration cannot provide two-dimensional information, but advantageously can secure sufficient sensitivity.

Figure 5:
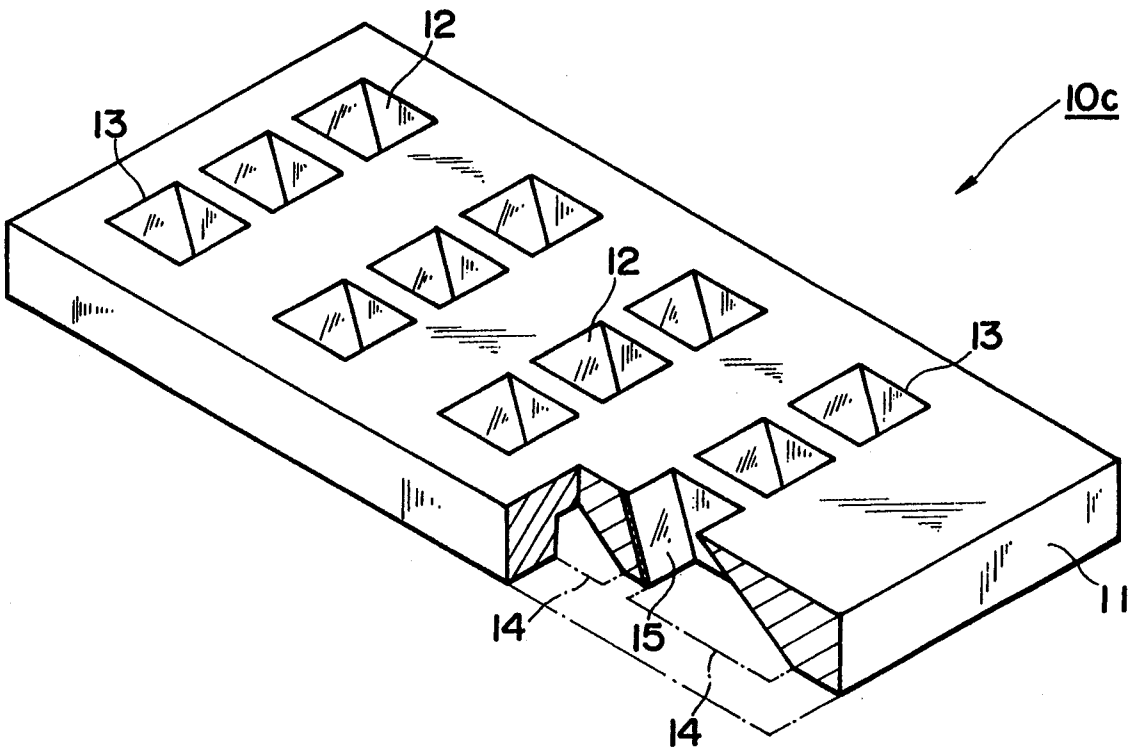
FIG. 5 is a partially broken perspective view of a dynode having through-holes of further another configuration.

A third embodiment of the dynodes constituting the electron multiplier is shown in FIG. 5.

Each of the dynodes 10*c* according to the third embodiment includes through-holes 12 having square input openings 13 which are arranged two-dimensionally. Each of the through-holes 12 has rectangular section which increases its sectional area toward the output opening 14. The output opening 14 has a larger sectional area than the input opening 13. The electrons entering through the input opening 13 impinge on the secondary electron emitting surface 15, and the same function and effect as in the above-described embodiments can be achieved. The dynode of such configuration can be easily mask-patterned in fabrication, can allow a larger area for the openings for electrons to enter through, and can provide dense two-dimensional information.

Figure 6:
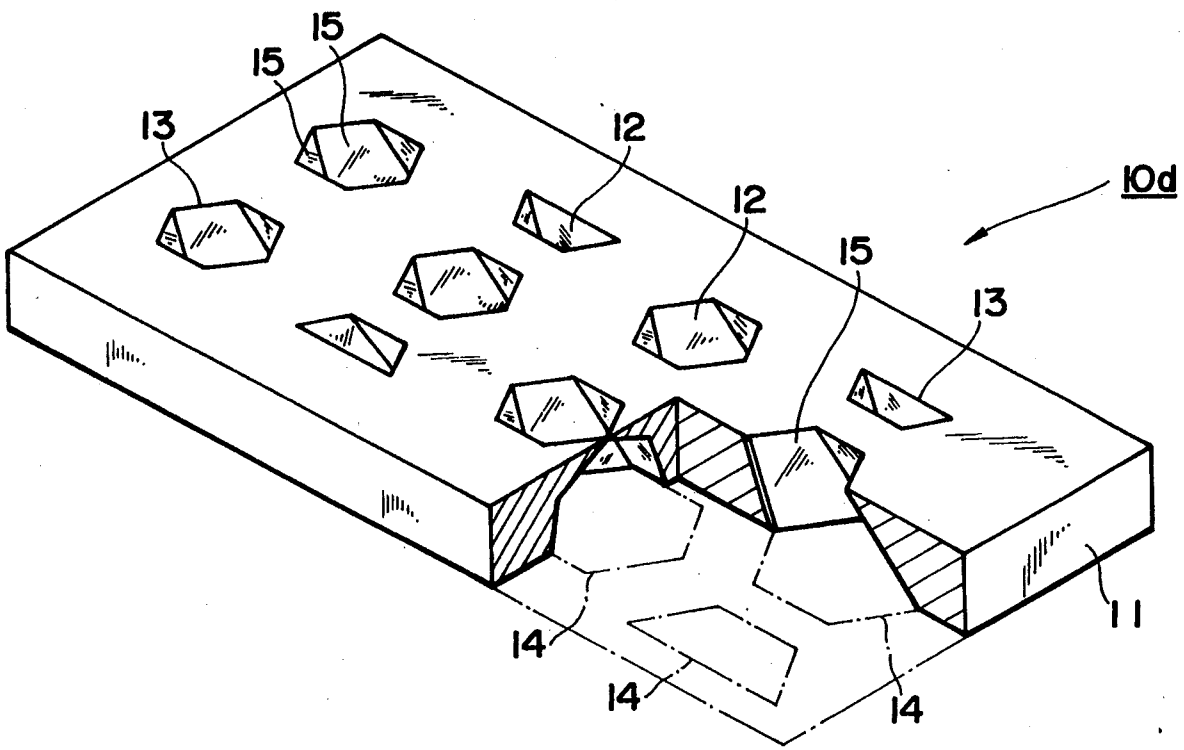
FIG. 6 is a partially broken perspective view of a dynode having through-holes of a different configuration.

FIG. 6 shows a fourth embodiment of the dynodes constituting the electron multiplier.

Each of the dynodes 10*d* according to the fourth embodiment includes through-holes 12 having hexagonal input openings 13 and output openings 14, or a half-hexagonal input openings 13 and output openings 14 which are arranged in a two-dimensional combination. Each of the through-holes 12 has polygonal section which increases toward the output opening 14. The output opening 14 has a larger sectional area than the input opening 13. The electrons which has entered through the input opening 13 impinge on the secondary electron emitting surface 15, and the same function and effect as in the above-described embodiments can be achieved. The dynodes 10*d* of such configuration cannot provide two-dimensional information, but advantageously can secure sufficient sensitivity.

Figure 7:
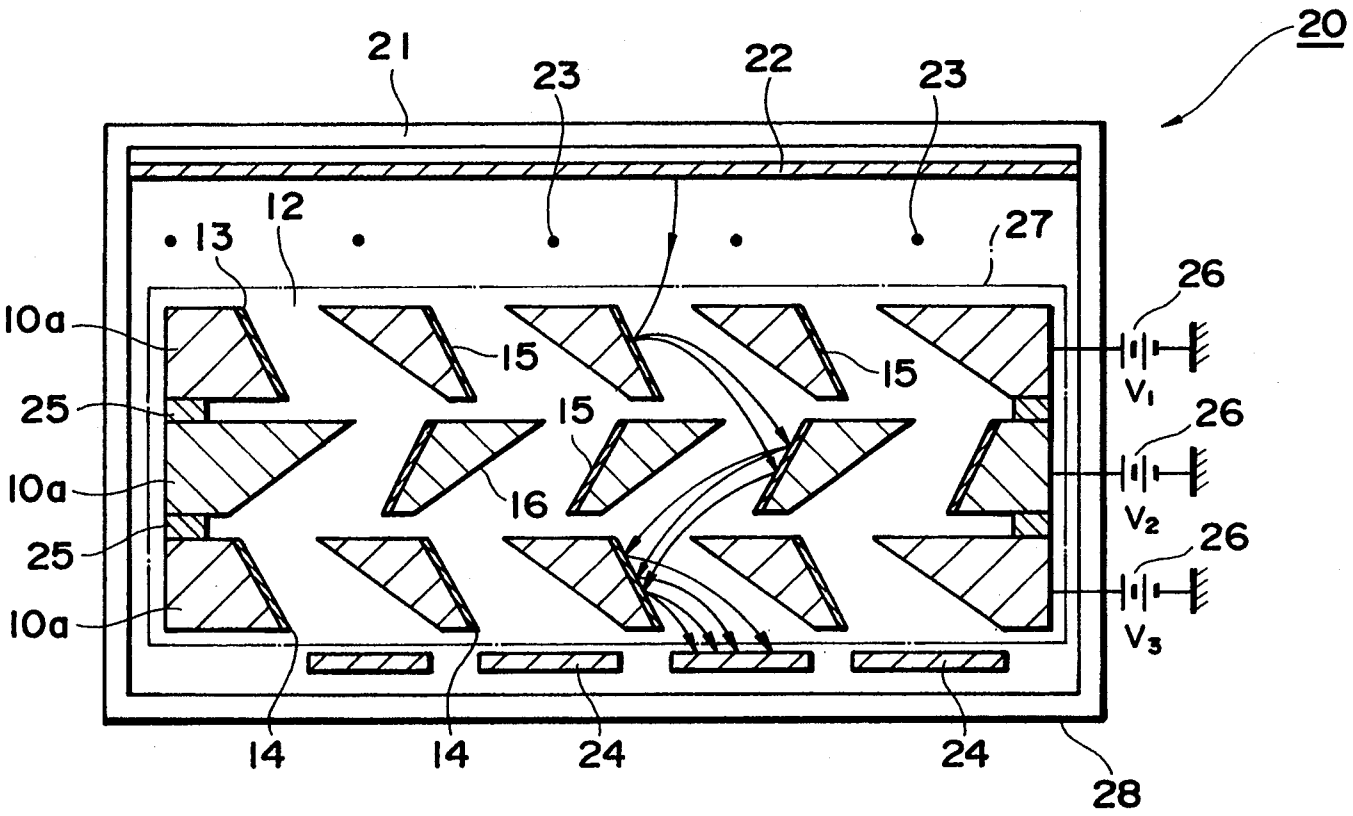
FIG. 7 is a sectional view of a photomultiplier with an electron multiplier constituted by the dynodes of FIG. 2.

FIG. 7 shows another embodiment of the electron tube with an electron multiplier according to this invention, which is a phototube with an electron multiplier including a plurality of stages of dynodes 1O*a*.

The photomultiplier 20 comprises in a vacuum vessel 28 a photocathode 22 for receiving an incident beam from an entrance window 21 to emit photoelectrons, convergence electrodes 23 for converging the emitted photoelectrons, an electron multiplier 27 for multiplying incident photoelectrons to output the multiplied electrons, and anodes 24 arranged corresponding to the output openings of the final dynode 1O*a* for taking out the multiplied photoelectrons.

The electron multiplier 27 comprises three stages of dynodes 1O*a* superposed, one on another, through spacers 25 for electric insulation. Each of the dynodes is laid one on another with one side of the plate 11 of each stage dynode arranged inverted so that the output openings 14 of each dynodes 10*a* are opposed to the input openings 13 of its adjacent one of the dynodes, and the through-holes of the former dynode 10*a* are directed opposite to those of the latter dynode 10*a*.

The convergence electrodes 23 are supplied with the same, or a higher, voltage than the photocathodes 22. The respective stage dynodes 10*a* are supplied with a voltage which is higher than the convergence electrodes 23 and which is adjusted by their associated power sources 28 to be $V_1 < V_2 < V_3$. The anodes 24 are supplied with a highest voltage.

When a beam enters the photomultiplier 20 of such structure through the entrance window 21, in response to the incident beam, photoelectrons are emitted from the photocathode 22. The emitted photoelectrons are converged by the convergence electrodes 23 to be incident on the first stage dynode 10*a* constituting the electron multiplier 27. The entering electrons impinge on the secondary electron emitting surfaces 15 of the through-holes 12 of the first stage dynode, and secondary electrons are emitted therefrom. The incident electron flows are multiplied. The multiplied incident electron flows enter a next stage one of the dynodes 10*a* to be again multiplied. Electron flows thus multiplied and emitted from the final stage one of the dynodes 1O*a* are taken out of the anodes 24 arranged corresponding to the output openings 14 of the final stage dynode 10*a*.

This photomultiplier 20 uses, as the electron multiplier, the dynodes 10*a* according to the first embodiment. However, it is possible to use the dynodes 10*b*~10*d*.

Figure 8:
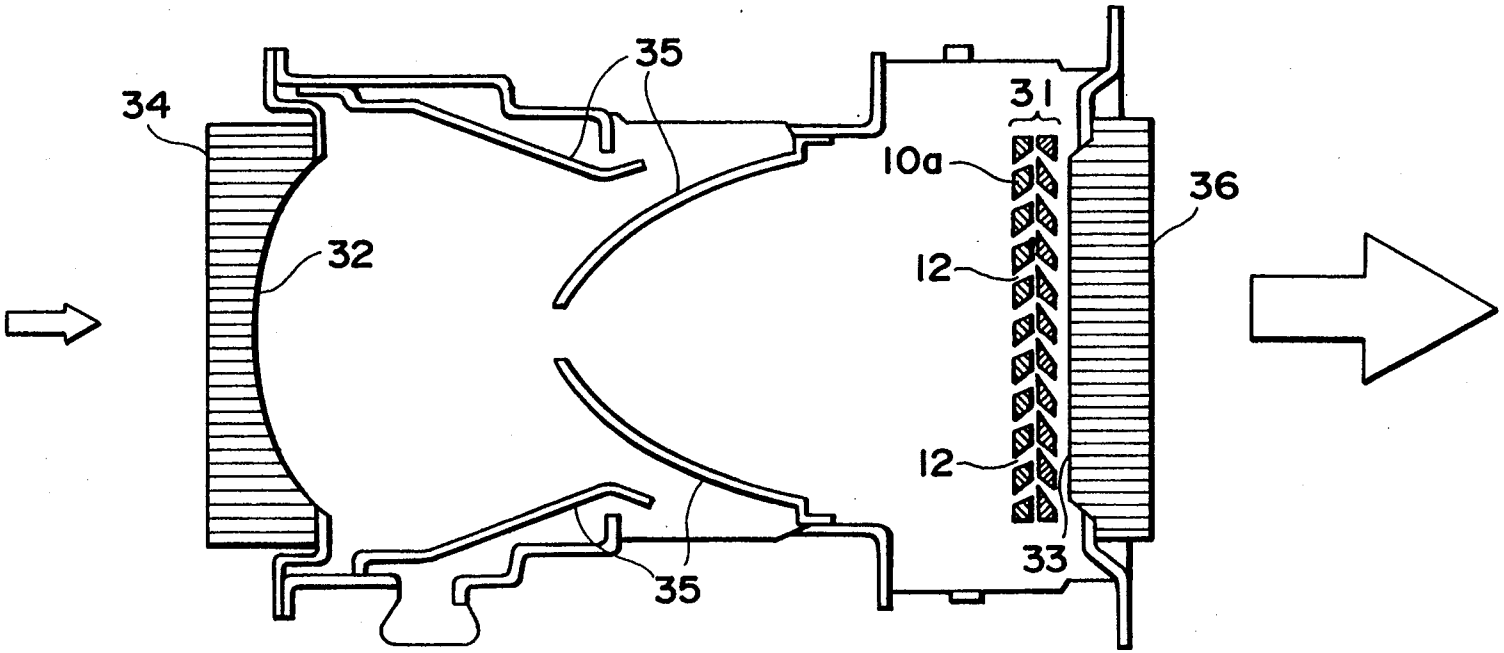
FIG. 8 is a sectional view of an image intensifier constituted by the dynodes of FIG. 2.

It is possible to apply the electron multiplier comprising such dynodes to an image intensifier. The image intensifier 30 of FIG. 8 includes an electron multiplier 31 constituted by, e.g., dynodes 1O*a*. This electron multiplier 31 is disposed between a photoelectric surface 32 and a fluorescence surface 33. In FIG. 8, for the convenience of explanation, two stages of dynodes 1O*a* are laid one on the other, but it is possible to use one stage of dynode 10*a*, or lay three or more stages of dynodes 10*a* one on another.

When a brightness image is incident on the image intensifier 30, beams enter through an entrance window 34, made of a fiber plate, to form an optical image on the photoelectric surface 32. Photoelectrons are emitted from points on the photoelectric surface 32 corresponding to intensities of the beams. The emitted photoelectrons are accelerated and converged by an electrode 35 constituting an electron lens to be incident on the electron multiplier 31. The photoelectrons entering the through-holes 12 of the electron multiplier 31 are multiplied and accelerated there, and impinge on the florescence surface 33. The fluorescence surface 33 emits fluorescence corresponding to intensities of a distribution of a photoelectron amount to form an image of visible light. This image is emitted through output windows 36 made of a fiber plate.

The above-described embodiment is used as the electron tube with an electron multiplier, an electron tube, a photomultiplier and image intensifier, but the electron tube with an electron multiplier is not limited to those applications and can be any electron tube with electron multipliers for multiplying entering electron flows.

Figure 9:
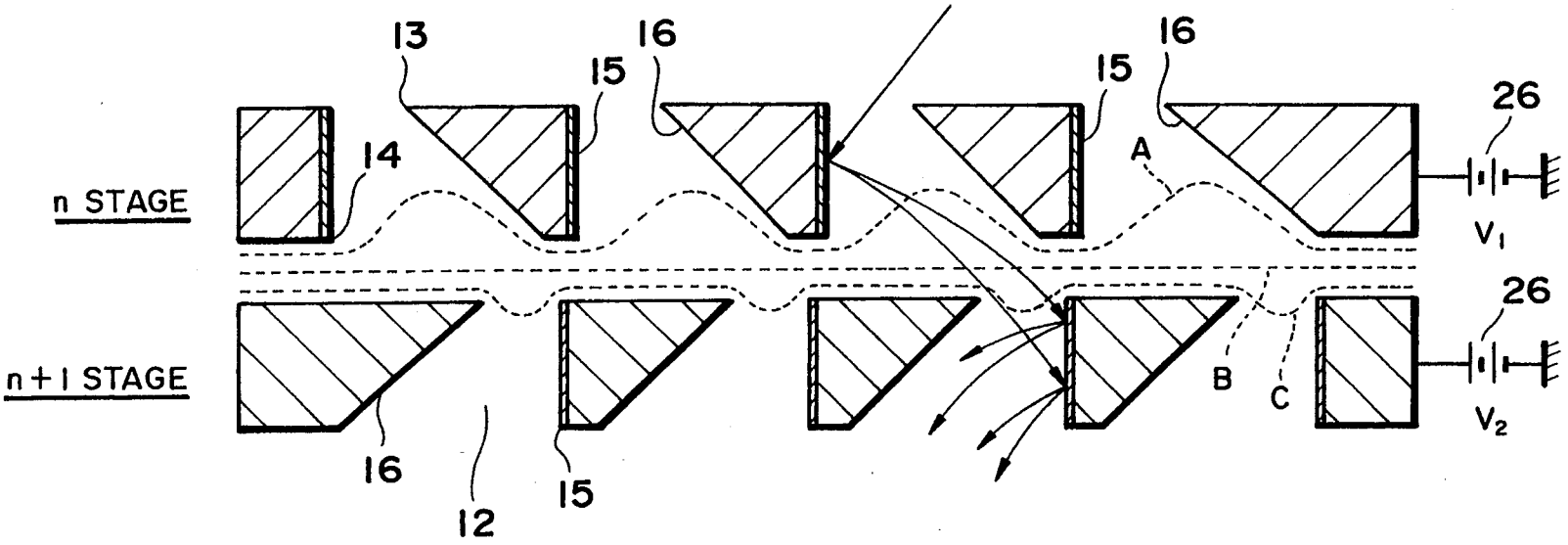
FIG. 9 is a sectional view of two continuous stage dynodes extracted out of a plurality of stages of dynodes constituting the electron multiplier according to a different embodiment.

In the above-described embodiments, the secondary electron emitting surfaces 15 on the inner surfaces of the respective through-holes 12 are, for example, slanted in the direction of thickness of the dynodes (axial direction of the electron tube), but may be parallel with the direction of thickness of the dynodes, as shown in FIG. 9. Even in the case that the through-holes 12 are thus formed, the equipotential line A enters through the output openings 14, ascends along the slant surfaces 16 opposed to the secondary electron emitting surfaces 15, and intrudes deep in the through-holes 12 (see FIGS. 1 and 3).

Figure 10:
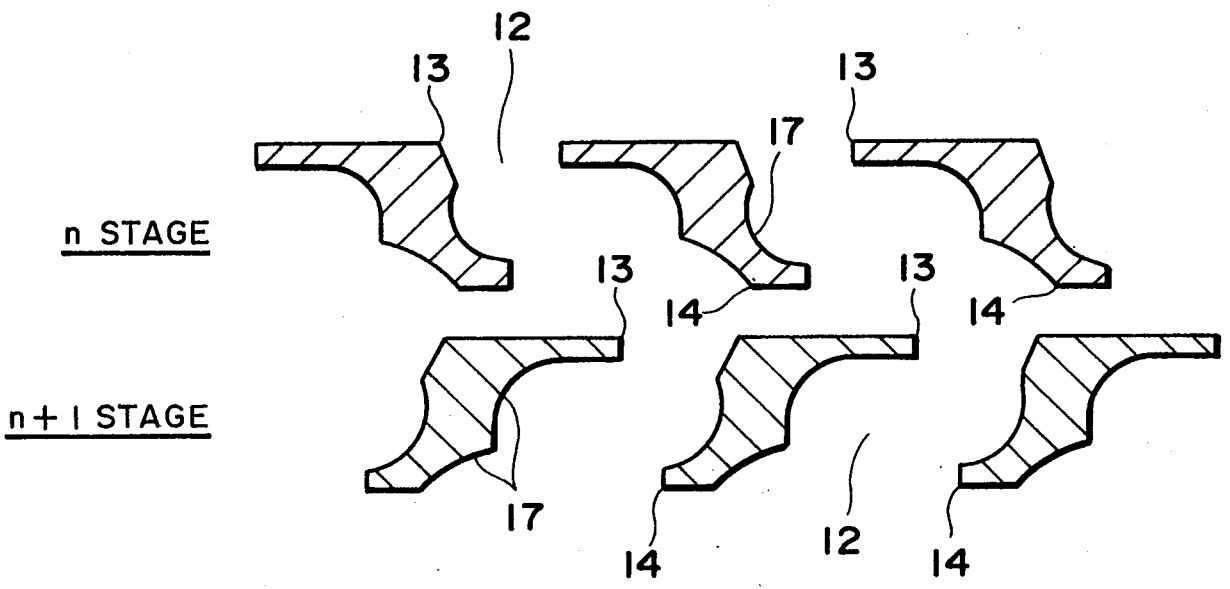
FIG. 10 is a sectional view of through-holes of different configuration formed in the dynodes.

In the above-described embodiments, all the inner surfaces of the respective through-holes 12 are straight slant surfaces but may have curved surfaces 17 as shown in FIG. 10.

In the above-described embodiments, the through-holes of the respective dynodes 10*a*~10*d* have input openings and output openings of the same shapes, i.e., circular input openings and circular output openings, or square input openings and square output openings, but the input and the output openings are not necessarily limited to this. It is possible to form, e.g., circular input openings corresponding to square output openings, as long as the output openings have a larger area than the input openings.

As described above, the electron tube with an electron multiplier according to this invention has the through-holes of the dynodes constituting the electron multiplier which is formed so that the output openings of the through-holes have a larger area than the input openings. Accordingly, the inner surfaces of the through-holes are tapered increasingly toward the output openings.

As a result, a control electric field for guiding secondary electrons to a next stage is formed so as to enter through the output openings of a larger area, ascend along the slant surfaces opposed to the secondary electron emitting surfaces, and intrude deep in the through-holes. Consequently intensities of control electric fields intruding into the through-holes can be so much increased that the emitted secondary electrons can be guided without failure to a next stage dynode, whereby an electron collecting ratio can be improved.

What is claimed is:

1. An electron tube having an electron multiplier for multiplying incident electron flows by secondary electron emission, said electron multiplier comprising:

a plurality of stacked stages of dynodes, each of said dynodes having a plurality of apertures therein, said apertures defining a number of separate dynode members;

a secondary electron emitting surface formed on an inner surface of each of said apertures;

an electron input opening and an electron output opening being defined at opposite ends of each of said apertures, said stages of dynodes being stacked so that the electron input openings of one stage are aligned with the electron output openings of an adjacent stage; and each of said electron output openings having a larger area than that of a corresponding electron input opening.

2. An electron tube with an electron multiplier according to claim 1, wherein the secondary electron emitting surface is formed on an inwardly projected part of the inner surface of the aperture.

3. An electron tube with an electron multiplier according to claim 2, wherein the electron input openings and the electron output openings are shaped as one of a circle, a rectangle and a hexagon.

4. An electron tube with an electron multiplier according to claim 2, wherein the electron multiplier further comprises convergence electrodes for converging orbits of electrons entering the dynode of the first stage.

5. An electron tube with an electron multiplier according to claim 2, wherein the electron tube is a photomultiplier with a photocathode for emitting photoelectrons by incident light beams.

6. An electron tube with an electron multiplier according to claim 2, wherein the electron tube is a photomultiplier with a photocathode for emitting photoelectrons by incident light beams, and wherein convergence electrodes there are provided for converging incident electrons between the photocathode and the dynode of the first stage.

7. An electron tube with an electron multiplier according to claim 2, wherein the electron tube is an image intensifier for increasing luminance of an input optical image.

8. An electron tube with an electron multiplier according to claim 2, wherein the dynode of each stage is stacked on the dynode of an adjacent stage so that a direction of slant of the secondary electron emitting surfaces of one dynode is opposite to the slant of the secondary electron emitting surfaces of the adjacent dynode.

9. An electron tube with an electron multiplier according to claim 8, wherein the electron input openings and the electron output openings are shaped as one of a circle, a rectangle and a hexagon.

10. An electron tube with an electron multiplier according to claim 8, wherein the electron multiplier further comprises convergence electrodes for converging orbits of electrons entering the dynode of the first stage.

11. An electron tube with an electron multiplier according to claim 8, wherein the electron tube is a photomultiplier with a photocathode for emitting photoelectrons by incident light beams.

12. An electron tube with an electron multiplier according to claim 8, wherein the electron tube is a photomultiplier with a photocathode for emitting photoelectrons by incident light beams, and wherein convergence electrodes there are provided for converging incident electrons between the photocathode and the dynode of the first stage.

13. An electron tube with an electron multiplier according to claim 8, wherein the electron tube is an image intensifier for increasing luminance of an input optical image.

14. An electron tube with an electron multiplier according to claim 1, wherein the electron input openings and the electron output openings are shaped as one of a circle, a rectangle and a hexagon.

15. An electron tube with an electron multiplier according to claim 1, wherein the electron multiplier further comprises convergence electrodes for converging orbits of electrons entering the dynode of the first stage.

16. An electron tube with an electron multiplier according to claim 1, wherein the electron tube is a photomultiplier with a photocathode for emitting photoelectrons by incident light beams.

17. An electron tube with an electron multiplier according to claim 1, wherein the electron tube is a photomultiplier with a photocathode for emitting photoelectrons by incident light beams, and wherein convergence electrodes are provided for converging incident electrons between the photocathode and the dynode of the first stage.

18. An electron rube with an electron multiplier according to claim 1, wherein the electron tube is an image intensifier for increasing luminance of an input optical image.

* * * * *